United States Patent [19]

Soeda et al.

[11] 4,085,692

[45] Apr. 25, 1978

[54] MOTOR CONTROL APPARATUS FOR ELECTRICALLY-DRIVEN SEWING MACHINE

[75] Inventors: Katsuji Soeda; Fumio Sakuma; Mitsuhiro Oyama, all of Sukagawa, Japan

[73] Assignee: Yamamoto Electric Industrial Co., Ltd., Japan

[21] Appl. No.: 731,686

[22] Filed: Oct. 12, 1976

[30] Foreign Application Priority Data

Mar. 5, 1976 Japan ..... 51-23882

[51] Int. Cl.[2] ..... D05B 69/22

[52] U.S. Cl. ..... 112/275

[58] Field of Search ..... 112/219 A, 219 R, 219 B, 112/220, 67, 87, 275, 277; 336/30; 331/170

[56] References Cited

U.S. PATENT DOCUMENTS

| | | | |
|---|---|---|---|
| 3,564,376 | 2/1971 | Mais et al. | 112/219 A X |
| 3,622,854 | 11/1971 | Imai | 112/219 A X |
| 3,732,503 | 5/1973 | Rapp et al. | 336/30 X |

*Primary Examiner*—Werner H. Schroeder
*Assistant Examiner*—Peter Nerbun
*Attorney, Agent, or Firm*—Armstrong, Nikaido, Marmelstein & Kubovcik

[57] ABSTRACT

A motor speed control apparatus for an electrically-driven sewing machine capable of effecting single stitch comprises a main motor circuit for supplying a motor current to a motor from an AC power supply through a main switch and a semiconductor element with a controlled electrode, a first control means for controlling the semiconductor element in order to effect normal operation, a controller adapted to change between its first and second state so as to control the speed of the motor continuously when the first control means is energized, a second control means for controlling the semiconductor element for effecting single stitch, and a change-over means for changing over the operation between the first and second control means. The second control means includes means for setting the trigger voltage for conducting the semiconductor element, a switching element coupled with the trigger-voltage setting means, a bias means for energizing the switching element, and a charge-discharge circuit. The bias means has a needle position detector means for detecting the position of a needle bar. The bias means supplies the switching element with a first bias sufficient to turn the switching element on when the needle position detector means detects the absence of the needle bar at the predetermined position, and supplies the switching element with a second bias insufficient to turn the switching element on when the needle position detector means detects the fact that the needle bar is at the predetermined position. The charge-discharge circuit renders the bias means in such a state as to supply an insufficient bias to turn the switching element on for a predetermined period of time after the time point at which the controller is set in the states between the second states and the predetermined state between the first and second states, which the conduction of the switching means renders the trigger voltage setting means ineffective.

5 Claims, 1 Drawing Figure

MOTOR CONTROL APPARATUS FOR ELECTRICALLY-DRIVEN SEWING MACHINE

BACKGROUND OF THE INVENTION

1. Field of the Invention

This invention relates to an improvement in a motor speed control apparatus for the electrically-driven sewing machine capable of effecting single stitch.

2. Description of the Prior Art

The conventional speed control apparatus for the electrically-driven sewing machine capable of effecting single stitch comprises a main motor circuit for supplying a source voltage to the motor through a semiconductor element with a controlled electrode, a first control means for controlling the semiconductor element in order to effect normal operation, a controller adapted to change between its first and second state so as to control the speed of the motor continuously when the first control means is energized, a second control means for controlling the semiconductor element in order to effect single stitch, and change-over means for changing over the operation between the first and second means. The second control means includes a needle position detector means for detecting the position of a needle bar, a switch means connected in series with the needle position detector means, a trigger voltage supply means for applying a trigger voltage to the gate electrode of the semiconductor element, and a switch-operating means having a charge-discharge circuit for closing the switch means when the controller is set in the first state, and for opening the switch means for a predetermined period of time after the time point at which the controller is set in the states between the second state and the predetermined state between the first and second states. When the needle position detector means detects that the needle has reached the predetermined position with the switch means closed, the trigger voltage supply means are made ineffective. Such an apparatus is disclosed in the copending U.S. Patent Application entitled as "Electrically driven sewing machine control apparatus", filed Sept. 3, 1976, Ser. No. 720,380, now U.S. Pat. No. 4,078,507 by the same applicants. In this speed control apparatus, it is necessary to supply a large current to the relay coil of the switch-operating means in order to open the reed relay switch. Further, in order to shorten the time required for preparing following single-stitch after the completion of a single-stitch, the capacity of the capacitor included in the charge-discharge circuit is required to be small in order to shorten the discharge time. In this case, however, the charge time of the capacitor is also small, so that the reed relay switch is kept open for a short time. As a result, the trigger voltage supply means cannot be kept effective for a sufficient length of time in the case of requiring a large torque, thereby leading to the likelihood of failure in single-stitch operation. Furthermore, the high cost and bulikiness of the reed switch results in a high product cost and bulkiness of the speed control apparatus.

SUMMARY OF THE INVENTION

An object of the present invention is to provide a speed control apparatus for an electrically driven sewing machine capable of effecting single-stitch properly and free from any of the above-mentioned disadvantages.

Another object of the present invention is to provide a speed control apparatus for an electrically driven sewing machine capable of effecting single-stitch properly without generating any noise.

According to the present invention, there is provided a speed control apparatus in which a switching element is connected to trigger voltage supply means, an oscillator or preferably a sine-wave oscillator operating in response to the needle position detector means is used to apply a bias to the switching element, the on-off operation of the switching element is controlled directly by the use of the charge and discharge of the charge-discharge circuit, and the trigger voltage supply means is made effective or ineffective in accordance with the conduction or nonconduction of the switching element.

Now, since the oscillation output of the sine-wave oscillator is small, it is impossible to use the output of the oscillator directly as a bias in order to conduct the switching element for controlling the trigger voltage supply means. In view of this, the apparatus according to the present invention is provided with a bias supply for conducting the switching element on one hand and with a second switching element for controlling the bias supply on the other, so that the second switching element is controlled by the output of the sine-wave oscillator.

DESCRIPTION OF THE PREFERRED EMBODIMENTS

Figure 1:
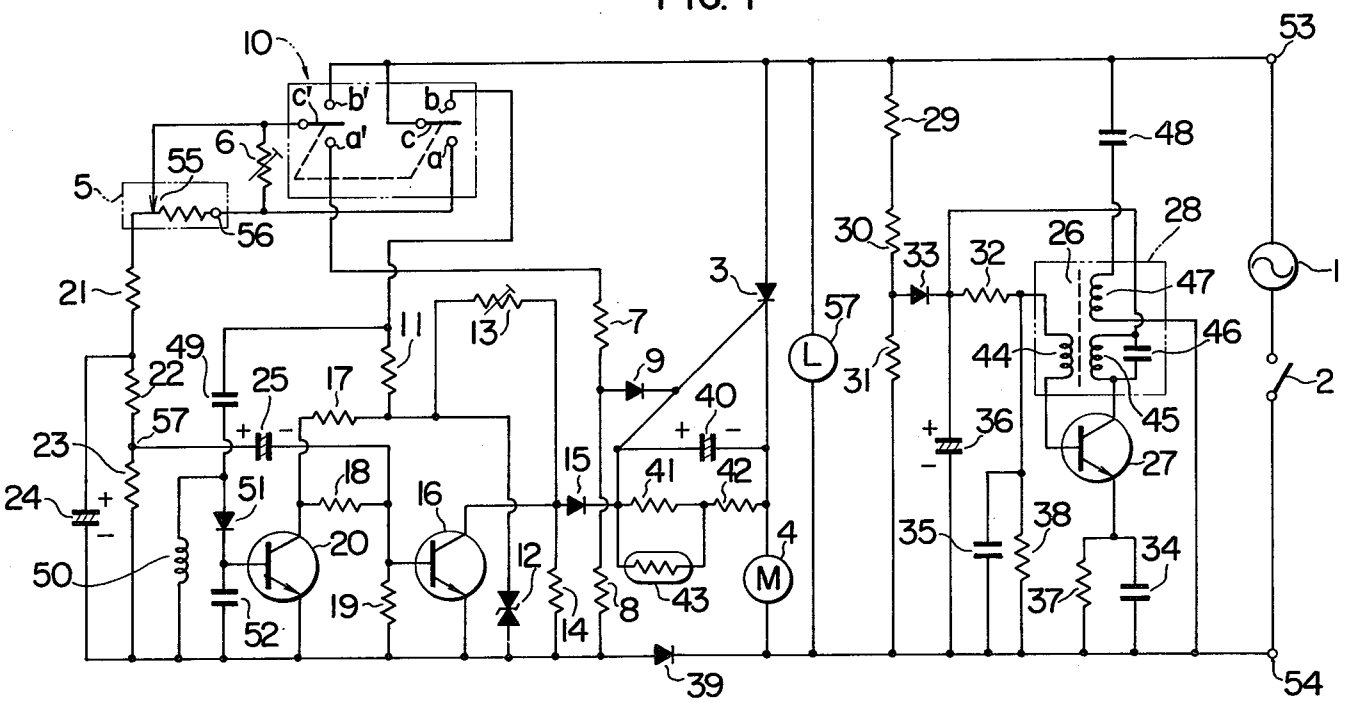
FIG. 1 is a circuit diagram showing an embodiment of the speed control apparatus according to the present invention.

A basic circuit configuration of an embodiment of the speed control apparatus according to the present invention is shown in FIG. 1. An AC power supply 1 is for supplying the motor current to a DC motor 4 through a main switch 2 and a semiconductor element with a controlled electrode such as a thyristor 3. The anode of the thyristor 3 is connected to a fixed contact *b'* and a movable contact *c* of a bipolar double-throw switch 10. The fixed contact *a'* of the switch 10 is connected through resistors 7 and 8 to the anode of a diode 39, the cathode of which is connected to a terminal 54. The junction point between the resistor 7 and the resistor 8 is connected to the anode of a diode 9, the cathode of which is connected to the gate electrode of the thyristor 3. The fixed contact *a* of the bipolar double-throw switch 10 is connected to a movable contact *c'* through a parallel circuit including a controller such as a variable resistor 5 and a semi-fixed resistor 6. The fixed contact *b* is connected through a resistor 11 and a constant-voltage element such as a bi-directional zener diode 12 to the anode of the diode 39. A series circuit including a semi-fixed resistor 13 and a resistor 14 is connected in parallel with the zener diode 12. The junction point between the resistors 13 and 14 is connected to the anode of a diode 15, the cathode of which is connected to the gate electrode of the thyristor 3. A series circuit including resistors 17, 18 and 19 is connected in parallel with the zener diode 12. The junction point between the resistors 18 and 19 is connected to the base electrode of a switching element such as an NPN transistor 16. The collector of the NPN transistor 16 is connected to the anode of the diode 15, and the emitter thereof to the anode of the diode 39. The fixed contact *b* is further connected through a capacitor 49 to the anode of a diode 51, the cathode of which is connected to the anode of the diode 39 through a capacitor 52. A coil 50 is connected between the anode of the diode 51 and the anode of the diode 39, the cathode of the diode 51 being connected to the base electrode of a switching element such as an NPN transistor 20. The collector of the NPN transistor 20 is connected to the junction point between the resistors 17 and 18, while the emitter thereof is connected to the anode of the diode 39. The fixed contact *a* is connected through the variable resistor 5 and resistors 21, 22 and 23 to the anode of the diode 39. An capacitor 24 is connected in parallel with the series circuit of the resistors 22 and 23. Another capacitor 25 is connected between the base of the transistor 16 and the junction point of the resistors 22 and 23. A capacitor 40 is connected between the gate electrode and the cathode of the thyristor 3. Series-connected resistors 41 and 42 are connected in parallel with the capacitor 40. A thermistor 43 is connected in parallel with the resistor 41. A pilot lamp 57 is connected to terminals 53 and 54, to which also series circuit of voltage-dividing resistors 29, 30 and 31 and a series circuit including a capacitor 48 and a coil 47 are connected. The junction point between the resistors 30 and 31 is connected to the anode of a diode 33, the cathode of which is connected to the terminal 54 through resistors 32 and 38 on one hand and to the terminal 54 through an electrolytic capacitor 36 on the other. A bypass capacitor 35 is connected in parallel with the resistor 38. The junction point between the resistors 32 and 38 is connected through a feed-back coil 44 of the transformer 28 to the base electrode of, for example, a NPN transistor 27, the collector of which is connected to the cathode of the diode 33 through the parallel circuit including a tank coil 45 and a capacitor 46. The emitter of the NPN transistor 27 is connected to the terminal 54 through the parallel circuit of a resistor 37 and a bypass capacitor 34. Needle position detector means such as a mechanical shutter 26, for detecting the fact that the needle (not shown) has reached a predetermined position, for example, an upper designated position, is disposed so as to be situated between the feed-back coil 44 and the tank coil 45 of the transformer 28. The transistor 27, the transformer 28, the voltage-dividing resistors 29, 30, 31 and 32, the diode 33, the capacitors 34, 35 and 36, and the resistors 37 and 38 composes a sine-wave oscillator, namely, a Hartley-type oscillator. The diode 39 is for protecting the gate electrode of the thyristor 3 from the reverse electromotive force generated by the motor 4; the capacitor 40 for shaping the trigger voltage applied to the gate electrode off the thyristor 3 into the voltage having a easily phase-controllable waveform on one hand and for preventing the erroneous operation of the thyristor 3 due to noise on the other; and the resistors 41 and 42 for protecting the gate electrode of the thyristor 3 from an excess current, regulating the sensitivity of the gate electrode and, with the thermistor 43, compensating for the variation in gate sensitivity which may be caused by temperature changes. The capacitor 48 and the output coil 47 of the transformer 28 composes a circuit for supplying a high-frequency signal to the bias circuit of the transistor 20, while the series circuit including the capacitor 49 and the coil 50 composes a resonant circuit for applying a bias to the transistor 20.

The operation of the speed control apparatus shown in the drawing will now be explained. The operation of the mechanical shutter and the Hartley oscillator featuring the present invention is described at first. The mechanical shutter made of metal is interlinked with the needle bar in such a manner that it interposes between the feed-back coil 44 and the tank coil 45 of the transformer 28 in response to the movement of the needle bar thereby to cut off the magnetic coupling of the transformer 28 when the needle bar approaches a designated position such as an upper designated position, and further it moves away from the position between the feed-back coil 44 and the tank coil 45 in response to the movement of the needle bar when the needle bar goes away from the upper designated position, on the other hand, thereby to restoring the magnetic coupling of the transforming 28. For this purpose, the mechanical shutter 26 may take the form of either a metal plate mounted on the needle bar so as to move vertically with the needle bar or a fan-shaped metal member mounted perpendicularly to the upper shaft interlocked with the needle bar so to rotate about the axis of the upper shaft thereby to make one revolution for each reciprocation of the needle.

Now, assume that when the Hartely-type oscillator is electrically connected to the AC power supply 1 by turning on the main switch 2, a positive half cycle of the AC power supply 1 begins thereby to apply a voltage with its positive side at the terminal 53 and the negative side at the terminal 54. (Now, the half cycle of the source voltage of such a polarity condition as mentioned above will be called "a positive half cycle", and the half cycle of the opposite polarity will be called "a negative half cycle" hereafter.) The source voltage is divided by the resistors 29, 30 and 31, and the voltage across the resistor 31 charges the capacitor 36 through the diode 33. The charged voltage of the capacitor 36 is applied to the base electrode of the transistor 27 through the resistor 32 and the primary coil 44 on one hand and to the collector through a parallel-tuned tank circuit including the secondary coil 45 and the capacitor 46. During the negative half cycle of the source voltage the diode 33 is in reverse situation and therefore only the voltage during the positive half cycle is applied to the capacitor 36. In this way, DC current caused by smoothing the positive voltage by the capacitor 36 is supplied to the transistor 27.

Assume that the needle is not positioned at the upper designated position and therefore the mechanical shutter 26 is not interposed between the feed-back coil 44 and the tank coil 45. The feed-back coil 44 is magnetically coupled with the tank coil 45, so that the sine-wave high-frequency current flowing through the tank coil 45 is induced in the feed-back coil 44. The high-frequency current induced in the feed-back coil 44 is amplified by the transistor 27 and positively fed back to the feed-back coil 44 through the bypass capacitors 34 and 35, thus continuing the high-frequency oscillation. This high-frequency oscillation current is induced in the output coil 47 of the transformer 28 and flows back to the coil 47 through the capacitor 48, the fixed contact *b* of the bipolar double-throw switch 10, the capacitor 49, the coil 50 and the diode 39. The oscillation frequency of the Hartley-type oscillator is set at several hundreds KHz by appropriately selecting the inductance of the coil 45 and the capacity of the capacitor 46. Also, the capacity of the capacitors 48 and 49 and the inductance of the coils 47 and 50 are selected properly in such a manner as to form a series resonant circuit with respect to the high-frequency oscillation current of the Hartley-type oscillator.

When the needle approaches the upper designated position, the mechanical shutter 26 is interposed between the feet-back coil 44 and the tank coil 45, so that the magnetic coupling of the primary coil 44 and the secondary coil 45 is cut off and no high-frequency current of the tank coil 45 is induced in the feed-back coil 44, thus terminating the oscillation of the Hartley-type oscillator.

Next, the operation of the speed control apparatus will be explained in the case that the movable contacts *c* and *c'* of the bipolar double-throw switch 10 are thrown on the fixed contacts *a* and *a'* or the first control means side. The resistance value of each of the semi-fixed resistor 6 and the resistors 7 and 8 is set in such a manner that when the main switch 2 is closed without depressing the controller 5, i.e., with the resistance value *r* between the movable member 55 and the terminal 56 of the controller 5 at maximum, the voltage across the resistor 8 which is applied to the gate of the thyristor 3, namely, the trigger voltage, even at its maximum, is slightly lower than the trigger voltage level of the thyristor 3, so that the thyristor 3 fails to be fired even at the maximum trigger voltage. The fine regulation of the trigger voltage is accomplished by adjusting the resistance value of the semi-fixed resistor 6. When the main switch 2 is closed under this condition, the pilot lamp 57 is turned on and the positive half cycle of the power from the AC power supply 1 is supposed to start. The source current flows from the power supply through the terminal 53, the contact *a* of the bipolar double-throw switch 10 and a parallel circuit including the controller 5 and the semi-fixed resistor 6, and further to the resistor 21 thereby to charge the capacitor 24 on one hand and to the terminal 54 through the contact *a'*, the resistors 7 and 8 and the diode 39 on the other. When the following negative half cycle begins, no source current is supplied to the first control means because of the reverse connection of the diode 39. In this connection, if the needle is away from the upper designated position, the oscillator circuit begins to oscillate. However, since the movable contact *c* of the bipolar double-throw switch 50 is thrown on the contact *a*, the series oscillator circuit of the capacitor 49 and the coil 50 is in open state and therefore no high-frequency current is induced in the coil 50. Thus, only the source current associated with the positive half cycle flows to the first control means, thereby causing the voltage across the resistor 8 to be applied to the gate electrode of the thyristor 3 through the diode 9. In spite of this, the maximum value of the trigger voltage fails to reach the trigger voltage level, so that the thyristor 3 is kept non-conductive and the motor 4 remains stationary.

Next, assume that the controller 5 is slightly depressed and moves the movable contact 55 to the terminal 56 side thereby to reduce the resistance value *r* of the controller 5 to predetermined level. The maximum value of the trigger voltage reaches the trigger voltage level of the thyristor 3, thereby energizing the thyristor 3 at a certain firing phase with a small firing period, with the result that a positive pulsating current is supplied to the motor 4 for the first time thereby to start the same.

When the resistance value *r* is reduced further by further depressing the controller 5, the trigger voltage applied to the thyristor 3 increases thereby to advance the firing phase, i.e. increase the firing period of the thyristor 3, thus increasing the speed of the motor 4.

In this way, by adjusting the resistance value *r* of the controller 5, it is possible to transfer the motor 4 from start to high-speed operation continuously and smoothly.

Next, it is assumed that the movable contacts *c, c'* of the bipolar double-throw switch 10 are thrown on the fixed contacts *b* and *b'*, i.e., the second control means side. Now, the resistance value of each of the resistors 11 and 14 and the semi-fixed resistor 13 is set so as to satisfy the following condition that the maximum value of the voltage across the resistor 14, namely, the trigger voltage is slightly higher than the trigger voltage level of the thyristor 3, so that the thyristor 3 is energized at a certain firing phase with a small firing period thereby to rotate the motor 4 at a low speed lacking inertia. The fine adjustment of the trigger voltage for this purpose is possible by changing the resistance value of the semi-fixed resistor 13. Further, the resistance value of each of the resistors 11, 17, 18 and 19 is so set that upon the application of the source voltage, the voltage across the resistor 19 reaches a value enough to conduct the transistor 16.

Reference is made to the case where the main switch 2 is closed without depressing the controller 5, i.e., with the resistance value *r* at its maximum. In view of the fact that the diode 39 is connected reversely with respect to the negative half cycle of the source voltage, only the positive half cycle of the source voltage is applied to the second control means. When the positive half cycle of the AC power supply 1 begins, the source current flows through the fixed contact *b* of the bipolar double-throw switch 10 to the trigger voltage-setting means including the resistors 11 and 14, the semi-fixed resistor 13 and the zener diode 12 as well as to the first bias means including the resistors 11, 17, 18 and 19 on the one hand, and through the fixed contact *b'* of the bipolar double-throw switch 10 to the charge-discharge circuit including the controller 5, the resistors 21, 22 and 23 and the capacitors 24 and 25 on the other. In this configuration, the resistor 11 is for protecting the zener diode 12, and resistor 21 and the capacitor 24 composes a smoothing circuit. The current that has reached the trigger voltage-setting means and the first bias means flows through the resistor 11 and the zener diode 12 thereby to generate a constant-peak voltage across the zener diode 12. This constant-peak voltage is applied across the series circuit including the semi-fixed resistor 13 and the resistor 14 on one hand and across the series circuit including the resistors 17, 18 and 19 on the other. The current which has passed the charge-discharge circuit, by contrast, flows through the controller 5 by way of the movable contact 55 thereof and is smoothed by the series circuit including the resistor 21 and the capacitor 24, and the smoothed current flows through the resistors 22, 23 and charges the capacitor 25.

Consider the case where the needle bar is away from the upper designated position, the mechanical shutter 26 is away from the position between the feed-back coil 44 and the tank coil 45 of the transformer 28, so that the Hartley-type oscillators to thereby generate the sine-wave high-frequency current flowing through the capacitor 48, the fixed contact *b* of the bipolar double throw switch 10, the capacitor 49 and the coil 50. The voltage generated across the coil 50 by the high-frequency current is rectified by the diode 51 and smoothed by the capacitor 52 to thereby applies a bias to the base electrode of the transistor 20 and turns on the transistor 20. When the transistor 20 is turned on, the series circuit including the resistors 18 and 19 is short-circuited, thereby rendering the first bias means ineffective. As a result, the bias voltage applied to the base of the transistor 16 is reduced to zero, thus cutting off the transistor 16. In the cut-off state of the transistor 16, the voltage across the resistor 14 is applied as a trigger voltage through the diode 15 to the gate of the thyristor 3, so that the thyristor 3 is turned on at a predetermined firing angle phase with a small firing period, thus rotating the motor 4 at a low speed lacking inertia. The rotation of the motor 4 causes the mechanical shutter 26 interlinked with the needle to move. When the needle reaches the upper designated position soon, the mechanical shutter 26 interposes itself between the feed-back coil 44 and the tank coil 45 of the transformer 28, thus cutting off the magnetic coupling of the feed-back coil and the tank coil thereby to stop the oscillation of the Hartley-type oscillator. Thus no high-frequency current flows through the coil 50, so that the voltage across the capacitor 52 is reduced to zero, thereby turning off the transistor 20. When the transistor 20 is turned off, the current that has flowed into the collector of the transistor 20 through the resistor 17 begins to flow through the resistors 18 and 19, so that the transistor 16 turns on. Upon the turning on of the transistor 16, the resistor 14 is short-circuited and the trigger voltage applied to the gate electrode of the thyristor 3 reduces to zero. The trigger voltage-setting means is thus rendered ineffective thereby to turn off the thyristor 3. Upon the turn off of the thyristor, the motor 4 immediately stops rotating, thereby keeping the needle bar stationary at the upper designated position. Under this condition, the Hartley-type oscillator continues to fail to oscillate and the transistor 20 is kept in cut-off state. Therefore, the transistor 16 continues to conduct, rendering the trigger voltage-setting means ineffective continuously. The needle bar is thus maintained at the upper designated position. In other words, in the absence of depression of the controller 5, if the needle bar is at the upper designated position with the main switch 2 closed, the motor 4 remains stationary, thus holding the needle bar at the upper designated position; while if the needle bar is not situated at the upper designated position, the motor 4 rotates slowly until the needle bar reaches the upper designated position, so that when the needle bar reaches the upper designated position, the motor 4 stops immediately, thus holding the needle bar at the upper designated position.

Now, reference is made to the case where the controller 5 is depressed fully with the needle bar at the upper designated position. In this case, upon the depression of the controller, the divided voltage across the series circuit of the resistors 22 and 23 is reduced and the capacitor 24 discharges through the resistors 22 and 23. However, since the capacitor 24 has a very small capacity, no other elements are affected by the discharge current. Now the ratio of the value of the composite resistance of the series circuit including the resistors 21 and 22 and the controller 5 to the resistance value of the resistor 23 becomes higher when compared with the ratio prior to the depression of the controller 5, so that the electric potential at the junction point 57 between the resistors 22 and 23 reduces and the capacitor 25 begins to discharge through the resistors 23 and 19 with the time constant predetermined by the resistance values of the resistors 23 and 19 and the capacity of the capacitor 25, and thus continues to discharge until the potential at the terminal 57 drops to a predetermined value. Then, the discharge current of opposite polarity is superimposed on the source current causing the base bias to be applied to the transistor 16, so that the voltage across the resistor 19 drops below the base bias of the transistor 16, thus turning off the transistor 16. When the transistor 16 is turned off, the source current that has flowed from the resistor 13 to the collector electrode of the transistor 16 begins to flow in the resistor 14. Thus a trigger voltage is applied to the gate of the thyristor 3 thereby to start the motor 4 at a low speed lacking inertia. With the rotation of the motor 4, the needle bar comes away from the upper designated position, thereby moving the mechanical shutter away from the position between the feed-back coil 44 and the tank coil 45 of the transformer. As a result, the Hartley-type oscillator begins to oscillate. With the oscillation of the Hartley-type oscillator, the transistor 20 turns on, so that the transistor 16 is kept in cut off state without regard to whether or not the discharge current flows through the resistor 19, thus the motor 4 continues to rotate. When the mechanical shutter 26 interposes in the space between the feed-back coil 44 and the tank coil 45 by the subsequent proximity of the needle bar to the upper designated position, the Hartley-type oscillator stops oscillating, thereby turning off the transistor 20. At this time, since the capacitor 25 has already discharged completely, no discharge current flows through the resistor 19 and therefore the transistor 16 is turned on. The trigger voltage-setting means is thus made ineffective and the motor 4 immediately stops rotating, thus holding the needle bar at the upper designated position. As seen, by depressing the controller 5, the single stitch is accomplished automatically.

The time, during which discharge current enough to turn off the transistor 16 is allowed to flow through the resistor 19, is required to be longer than the time required for the mechanical shutter 26 to be away from the position between the feed-back coil 44 and tank coil 45 enough to restore the magnetic coupling after the start of movement of the shutter, but shorter than the timer required for the mechanical shutter to approach the space between the feed-back coil 44 and the tank coil 45 again enough to cut off the magnetic coupling thereof. This is accomplished by appropriately determining the time constant decided by the capacity of the capacitor 25 and resistance values of the resistors 19 and 23.

In effecting single stitch, the controller 5 may be released from depressed condition immediately after the mechanical shutter 26 moves away from the space between the coil 44 and the coil 45, or may be kept depressed until the mechanical shutter 26 interposes into the space between the coil 44 and the coil 45 again. Even if the controller 5 is kept depressed after completing single stitch, the motor 4 remains stationary since the capacitor 25 has already discharged.

For the next single-stitch operation, the controller 5 must be temporarily released for charging the capacitor 25 and it must be depressed again when the capacitor 25 has completely charged.

It will thus be understood that in the speed control apparatus according to the present invention, the means for supplying a trigger voltage to the thyristor is controlled by means of a first switching element and the on-off operation of the first switching element is controlled by the charge-discharge circuit, thus assuring a proper single stitch. Also, the sine-wave oscillator is used as a means for applying a bias to a second switching element and therefore no noises are generated. Further, the employing of the mechanical shutter as the needle position detector means leads to the great durability and low cost of the apparatus.

The control apparatus according to the invention may alternatively be so constructed that the mechanical shutter interposes between the coil 44 and the coil 45 when the needle bar is situated at the lower instead of upper designated position. Further, two couple of mechanical shutters and transformers respectively for detecting the upper and lower designated positions may be provided for enabling selection of the stationary or dwell position of the needle bar as desired.

Furthermore, a triac may replace the thyristor as the semiconductor element with controlled electrode, for controlling an AC motor.

We claim:

1. A motor speed control apparatus for an electrically-driven sewing machine capable of effecting a single stitch, comprising:

a main motor circuit for supplying a motor current from an AC power supply through a main switch and a semiconductor element with a controlled electrode to a motor;

a first control means for controlling said semiconductor element in order to effect normal operation;

a controller adapted to change between a first and a second state to control the speed of said motor continuously when said first control means is energized;

a second control means for controlling said semiconductor element in order to effect a single stitch wherein said controller initiates the operation of the single stitch; and a change-over means for changing over the operation between said first and said second control means; and said second control means including means for setting the trigger voltage for turning on said semi-conductor element, a switching element coupled with said trigger-voltage setting means, a bias means for energizing said switch element, and a charge-discharge circuit means, said bias means having a needle position detector means for detecting the position of a needle bar, said bias means supplying said switching element with a first bias to hold said switching element off when said needle position detector means detects the absence of said needle bar at said predetermined position, and supplying said switching element with a second bias sufficient to turn said switching element on when said needle position detector means detects the fact that said needle bar is at said predetermined position, said charge-discharge circuit means preventing said bias means from supplying a sufficient bias to turn said switching element on for a predetermined period of time after said controller is operated to initiate the single stitch operation, said trigger voltage setting means being rendered ineffective by the conduction of said switching means.

2. A speed control apparatus according to claim 1, wherein said bias means includes an oscillator circuit, said oscillator circuit oscillating and applying said first bias to said switching element thereby to turn on said switching element when said needle position detector means detects the absence of said needle at said predetermined position.

3. A speed control apparatus according to claim 2, wherein said oscillator circuit includes a transformer having a first coil and a second coil, said needle position detector means including a mechanical shutter for controlling the magnetic coupling between said first and second coils of said transformer, said mechanical shutter cutting off said magnetic coupling and stopping the oscillation of said oscillator circuit when said needle reaches said predetermined position.

4. A motor speed control apparatus for an electrically-driven sewing machine capable of effecting a single stitch, comprising:

a main motor circuit for supplying a motor current from an AC power supply through a main switch and a semiconductor element with a controlled electrode to a motor;

a first control means for controlling said semiconductor element in order to effect normal operation;

a controller adapted to change between a first and second state to control the speed of said motor continuously when said first control means is energized;

a second control means for controlling said semiconductor element in order to effect a single stitch wherein said controller initiates the operation of the single stitch;

a change-over means for changing over the operation between said first control means and said second control means; and said second control means including means for setting a trigger voltage for turning on said semiconductor element, a first switching element coupled with said trigger-voltage setting means, a first bias means for applying said first switching element with a bias sufficient to turn said first switching element on, a second switching element coupled with said first bias means, a second means for controlling said second switching element, and a charge-discharge circuit means, said second bias means including a needle position detector means for detecting the position of a needle bar and a sine-wave oscillator circuit;

said sine-wave oscillator oscillating and supplying said second switching element with a first bias sufficient to turn said second switching element on when said needle position detector means detects the absence of said needle bar at said predetermined position, and stopping oscillation and supplying said second switching element with a second bias to turn said second switching element off when said needle position detector means detect said needle bar at said predetermined position, said charge-discharge circuit means preventing said first bias means from supplying a sufficient bias to turn said first switching element on for a predetermined period of time after said controller is operated to initiate a single stitch operation, said second switching means preventing said first bias means from supplying a sufficient bias to turn said first switching element on when said second switching element is on, said trigger-voltage setting means being rendered ineffective by the conduction of said first switching element.

5. A speed control apparatus according to claim 4, wherein said sine-wave oscillator circuit includes a transformer having a first and a second coil, said needle position detector means include a mechanical shutter for controlling the magnetic coupling between said first and second coils of said transformer, said mechanical shutter stopping the oscillation of said sine-wave oscillator circuit by cutting off said magnetic coupling when said needle reaches said predetermined position.

* * * * *